US011156363B2

(12) United States Patent
Kramer et al.

(10) Patent No.: US 11,156,363 B2
(45) Date of Patent: Oct. 26, 2021

(54) DIRT TOLERANT PINS FOR COMBUSTOR PANELS

(71) Applicant: United Technologies Corporation, Farmington, CT (US)

(72) Inventors: Stephen K. Kramer, Cromwell, CT (US); Ryan Lundgreen, Granby, CT (US); Robin Prenter, Avon, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 313 days.

(21) Appl. No.: 16/212,791

(22) Filed: Dec. 7, 2018

(65) Prior Publication Data

US 2020/0182470 A1 Jun. 11, 2020

(51) Int. Cl.
*F23R 3/00* (2006.01)
*F23R 3/42* (2006.01)

(52) U.S. Cl.
CPC ..... *F23R 3/42* (2013.01); *F23R 3/002* (2013.01); *F05D 2260/22141* (2013.01); *F23R 2900/03043* (2013.01); *F23R 2900/03044* (2013.01)

(58) Field of Classification Search
CPC .. F23R 3/002; F23R 3/04; F01D 5/187; F05D 2260/22141
See application file for complete search history.

(56) References Cited

U.S. PATENT DOCUMENTS 2,892,618 A 6/1959 Holm
4,064,300 A 12/1977 Bhangu
4,446,693 A 5/1984 Pidcock et al.
6,514,042 B2 * 2/2003 Kvasnak ..... F01D 5/187 415/115
7,886,541 B2 * 2/2011 Woolford ..... F23R 3/002 60/752
7,938,624 B2 * 5/2011 Tibbott ..... F01D 5/187 415/115
8,024,933 B2 9/2011 Woolford et al.
2005/0047932 A1 3/2005 Nakae et al.
2011/0056669 A1 3/2011 Pruett et al.
2012/0297783 A1 11/2012 Melton et al.
2014/0096527 A1 * 4/2014 Bangerter ..... F23R 3/002 60/754
2016/0025010 A1 1/2016 Soucy et al.
2016/0258626 A1 9/2016 Moura et al.
2016/0312623 A1 * 10/2016 Zelesky ..... F01D 9/041

OTHER PUBLICATIONS

The Extended European Search Report for Application No. 19214131.5-1009; Report dated Mar. 3, 2020; Report Received Date: Mar. 10, 2020; 9 pages.

* cited by examiner

*Primary Examiner* — Todd E Manahan
*Assistant Examiner* — Thuyhang N Nguyen
(74) *Attorney, Agent, or Firm* — Cantor Colburn LLP

(57) ABSTRACT

A gas turbine engine component assembly including: a first component having a first surface and a second surface opposite the first surface; and a second component having a first surface, a second surface opposite the first surface of the second component, and a plurality of pin fins extending away from the second surface of the second component, the first surface of the first component and the second surface of the second component defining a cooling channel therebetween, wherein the plurality of pin fins extend into the cooling channel, wherein each of the plurality of pin fins have a pointed ellipse shape.

14 Claims, 6 Drawing Sheets

DIRT TOLERANT PINS FOR COMBUSTOR PANELS

BACKGROUND

The subject matter disclosed herein generally relates to gas turbine engines and, more particularly, to a method and apparatus for mitigating particulate accumulation on cooling surfaces of components of gas turbine engines.

In one example, a combustor of a gas turbine engine may be configured and required to burn fuel in a minimum volume. Such configurations may place substantial heat load on the structure of the combustor (e.g., heat shield panels, combustion liners, etc.). Such heat loads may dictate that special consideration is given to structures, which may be configured as heat shields or panels, and to the cooling of such structures to protect these structures. Excess temperatures at these structures may lead to oxidation, cracking, and high thermal stresses of the heat shields panels. Particulates in the air used to cool these structures may inhibit cooling of the heat shield and reduce durability. Particulates, in particular atmospheric particulates, include solid or liquid matter suspended in the atmosphere such as dust, ice, ash, sand, and dirt.

SUMMARY

According to an embodiment, a gas turbine engine component assembly is provided. The gas turbine component assembly including: a first component having a first surface and a second surface opposite the first surface; and a second component having a first surface, a second surface opposite the first surface of the second component, and a plurality of pin fins extending away from the second surface of the second component, the first surface of the first component and the second surface of the second component defining a cooling channel therebetween, wherein the plurality of pin fins extend into the cooling channel, wherein each of the plurality of pin fins have a pointed ellipse shape.

In addition to one or more of the features described above, or as an alternative, further embodiments may include that the plurality of pin fins are arranged in a staggered arrangement.

In addition to one or more of the features described above, or as an alternative, further embodiments may include: a guide rail extending from away from the second surface of the second component into the cooling channel, wherein the guide rail segments the plurality of pin fins into a first group and a second group.

In addition to one or more of the features described above, or as an alternative, further embodiments may include that the guide rail extends through the plurality of pin fins in a direction about parallel to a lateral airflow in the cooling channel.

In addition to one or more of the features described above, or as an alternative, further embodiments may include that each of the plurality of pin fins includes, a front, a back, a major axis, and a minor axis, wherein the minor axis bifurcates the major axis, such that a first distance between the front and the minor axis is about equal to a second distance between the back and the minor axis.

In addition to one or more of the features described above, or as an alternative, further embodiments may include that each of the plurality of pin fins includes a front, a back, a major axis, and a minor axis, wherein a first distance between the front and the minor axis is less than a second distance between the back and the minor axis.

In addition to one or more of the features described above, or as an alternative, further embodiments may include: a combustion liner having an inner surface and an outer surface opposite the inner surface; and a heat shield panel having a first surface, a second surface opposite the first surface of the heat shield panel, and a plurality of pin fins extending away from the second surface of the heat shield panel, the inner surface of the combustion liner and the second surface of the heat shield panel defining a cooling channel therebetween, wherein the plurality of pin fins extend into the cooling channel, wherein each of the plurality of pin fins have a pointed ellipse shape.

In addition to one or more of the features described above, or as an alternative, further embodiments may include that the plurality of pin fins are arranged in a staggered arrangement.

In addition to one or more of the features described above, or as an alternative, further embodiments may include: a guide rail extending from away from the second surface of the heat shield panel into the cooling channel, wherein the guide rail segments the plurality of pin fins into a first group and a second group.

In addition to one or more of the features described above, or as an alternative, further embodiments may include that the guide rail extends through the plurality of pin fins in a direction about parallel to a lateral airflow in the cooling channel.

In addition to one or more of the features described above, or as an alternative, further embodiments may include that each of the plurality of pin fins includes a front, a back, a major axis, and a minor axis, wherein the minor axis bifurcates the major axis, such that a first distance between the front and the minor axis is about equal to a second distance between the back and the minor axis.

In addition to one or more of the features described above, or as an alternative, further embodiments may include that each of the plurality of pin fins includes a front, a back, a major axis, and a minor axis, wherein a first distance between the front and the minor axis is less than a second distance between the back and the minor axis.

According to another embodiment, a gas turbine engine is provided. The gas turbine engine including: a combustor enclosing a combustion chamber having a combustion area, wherein the combustor comprises: a combustion liner having an inner surface and an outer surface opposite the inner surface; and a heat shield panel having a first surface, a second surface opposite the first surface of the heat shield panel, and a plurality of pin fins extending away from the second surface of the heat shield panel, the inner surface of the combustion liner and the second surface of the heat shield panel defining a cooling channel therebetween, wherein the plurality of pin fins extend into the cooling channel, wherein each of the plurality of pointed ellipse pin fins have a pointed ellipse shape.

In addition to one or more of the features described above, or as an alternative, further embodiments may include that the plurality of pin fins are arranged in a staggered arrangement.

In addition to one or more of the features described above, or as an alternative, further embodiments may include: a guide rail extending from away from the second surface of the heat shield panel into the cooling channel, wherein the guide rail segments the plurality of pin fins into a first group and a second group.

In addition to one or more of the features described above, or as an alternative, further embodiments may include that the guide rail extends through the plurality of pin fins in a direction about parallel to a lateral airflow in the cooling channel.

In addition to one or more of the features described above, or as an alternative, further embodiments may include that each of the plurality of pin fins includes a front, a back, a major axis, and a minor axis, wherein the minor axis bifurcates the major axis, such that a first distance between the front and the minor axis is about equal to a second distance between the back and the minor axis.

In addition to one or more of the features described above, or as an alternative, further embodiments may include that each of the plurality of pin fins includes a front, a back, a major axis, and a minor axis, wherein a first distance between the front and the minor axis is less than a second distance between the back and the minor axis.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION

The following descriptions should not be considered limiting in any way. With reference to the accompanying drawings, like elements are numbered alike:

The detailed description explains embodiments of the present disclosure, together with advantages and features, by way of example with reference to the drawings.

DETAILED DESCRIPTION

A detailed description of one or more embodiments of the disclosed apparatus and method are presented herein by way of exemplification and not limitation with reference to the Figures.

Combustors of gas turbine engines, as well as other components, experience elevated heat levels during operation. Impingement and convective cooling of heat shield panels of the combustor wall may be used to help cool the combustor. Convective cooling may be achieved by air that is channeled between the heat shield panels and a combustion liner of the combustor. Impingement cooling may be a process of directing relatively cool air from a location exterior to the combustor toward a back or underside of the heat shield panels.

Thus, combustion liners and heat shield panels are utilized to face the hot products of combustion within a combustion chamber and protect the overall combustor shell. The combustion liners may be supplied with cooling air including dilution passages which deliver a high volume of cooling air into a hot flow path. The cooling air may be air from the compressor of the gas turbine engine. The cooling air may impinge upon a back side of a heat shield panel that faces a combustion liner inside the combustor. The cooling air may contain particulates, which may build up on the heat shield panels over time, thus reducing the cooling ability of the cooling air. Embodiments disclosed herein seek to address particulate adherence to the heat shield panels in order to maintain the cooling ability of the cooling air.

Figure 1:
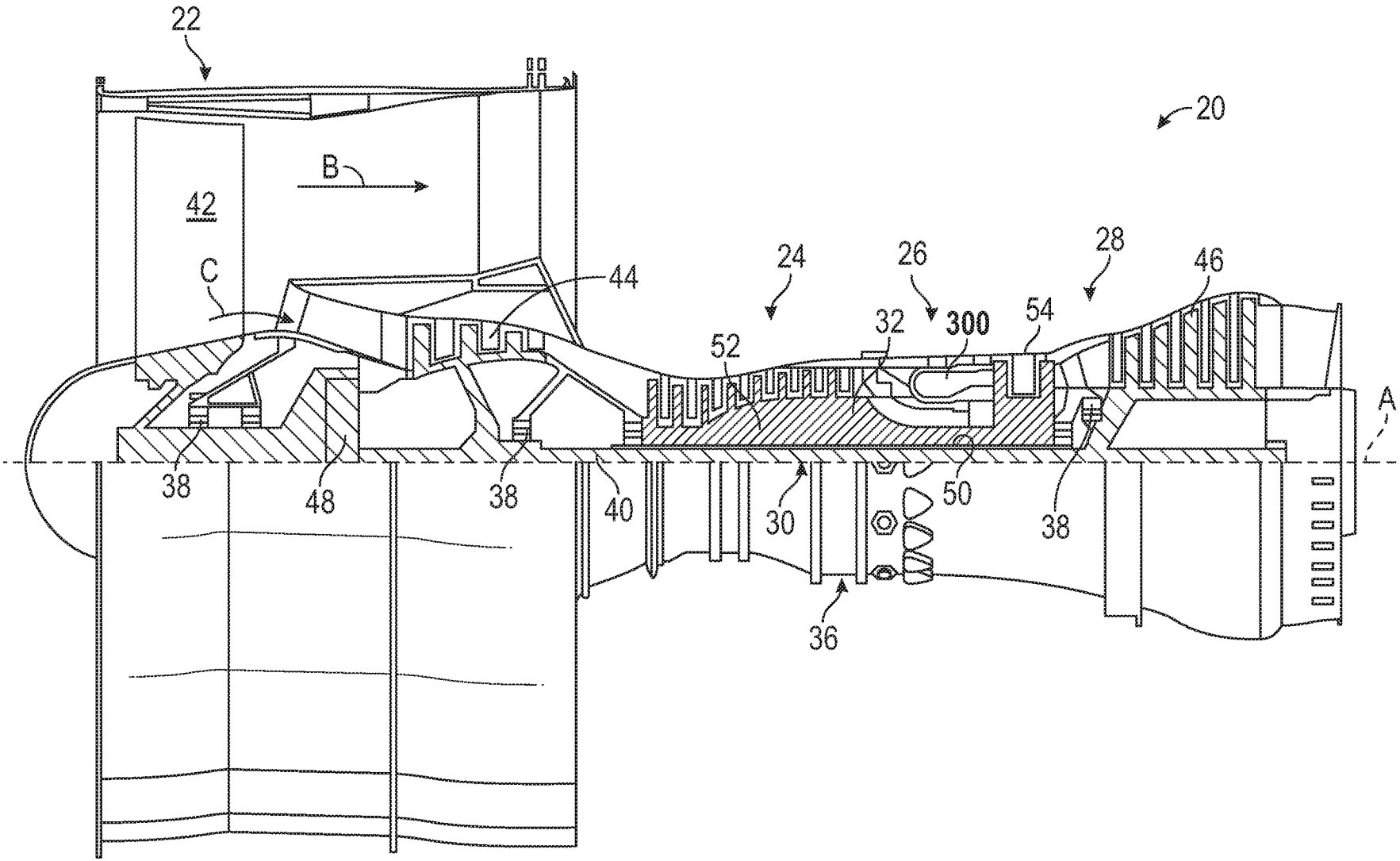
FIG. 1 is a partial cross-sectional illustration of a gas turbine engine, in accordance with an embodiment of the disclosure.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 300 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 300, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 m/sec).

Figure 2:
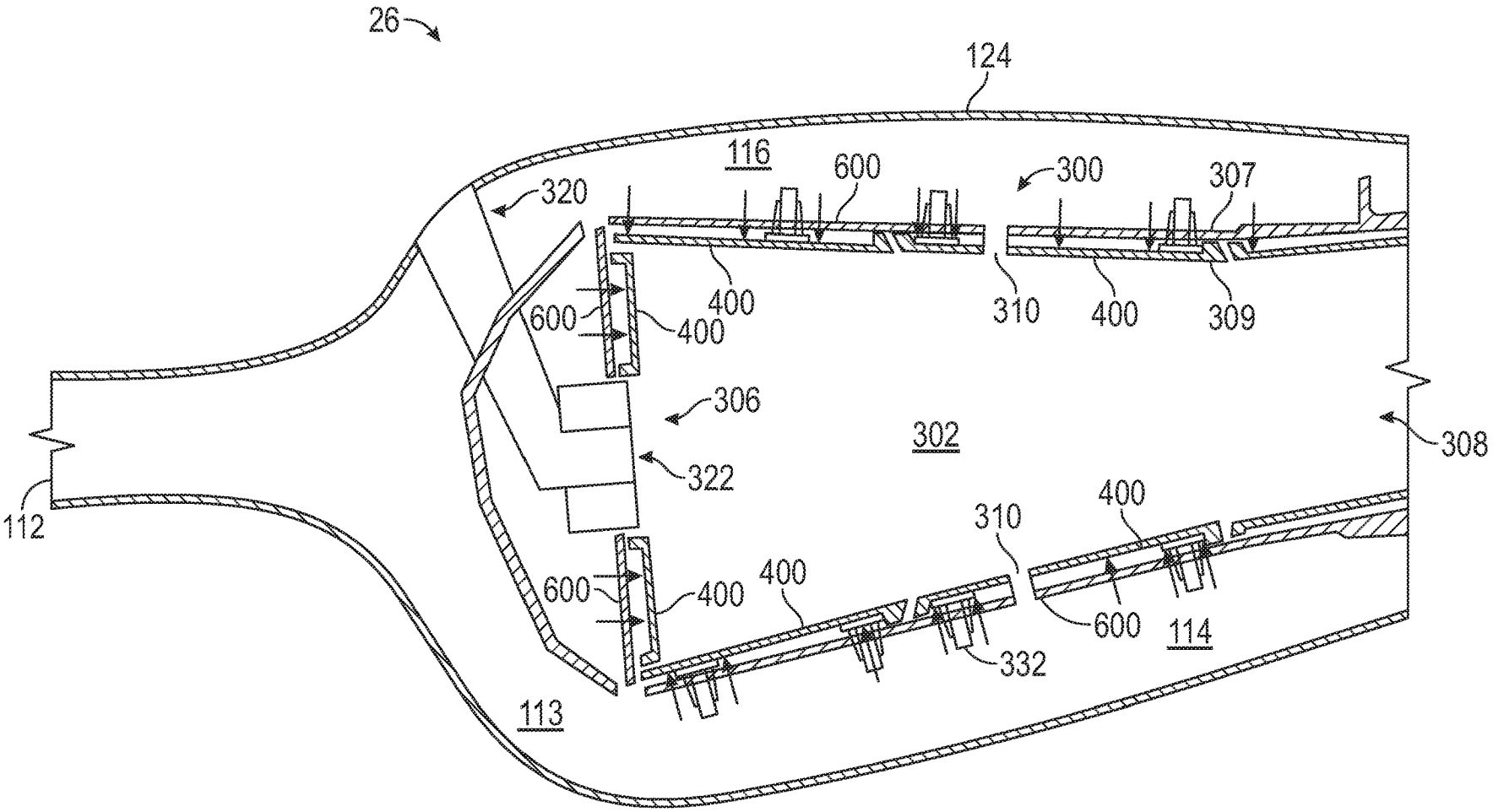
FIG. 2 is a cross-sectional illustration of a combustor, in accordance with an embodiment of the disclosure.

Referring now to FIG. 2 and with continued reference to FIG. 1, the combustor section 26 of the gas turbine engine 20 is shown. The combustor 300 of FIG. 2 is an impingement film float wall combustor. It is understood that while an impingement film float wall combustor is utilized for exemplary illustration, the embodiments disclosed herein may be applicable to other types of combustors for gas turbine engines including but not limited to double pass liner combustors and float wall combustors. As illustrated, a combustor 300 defines a combustion chamber 302. The combustion chamber 302 includes a combustion area 370 within the combustion chamber 302. The combustor 300 includes an inlet 306 and an outlet 308 through which air may pass. The air may be supplied to the combustor 300 by a pre-diffuser 110. Air may also enter the combustion chamber 302 through other holes in the combustor 300 including but not limited to quench holes 310, as seen in FIG. 2.

Compressor air is supplied from the compressor section 24 into a pre-diffuser 112, which then directs the airflow toward the combustor 300. The combustor 300 and the pre-diffuser 110 are separated by a dump region 113 from which the flow separates into an inner shroud 114 and an outer shroud 116. As air enters the dump region 113, a portion of the air may flow into the combustor inlet 306, a portion may flow into the inner shroud 114, and a portion may flow into the outer shroud 116.

The air from the inner shroud 114 and the outer shroud 116 may then enter the combustion chamber 302 by means of one or more impingement holes 307 in the combustion liner 600 and one or more secondary apertures 309 in the heat shield panels 400. The impingement holes 307 and secondary apertures 309 may include nozzles, holes, etc. The air may then exit the combustion chamber 302 through the combustor outlet 308. At the same time, fuel may be supplied into the combustion chamber 302 from a fuel injector 320 and a pilot nozzle 322, which may be ignited within the combustion chamber 302. The combustor 300 of the engine combustion section 26 may be housed within diffuser cases 124 which may define the inner shroud 114 and the outer shroud 116.

Figure 3:
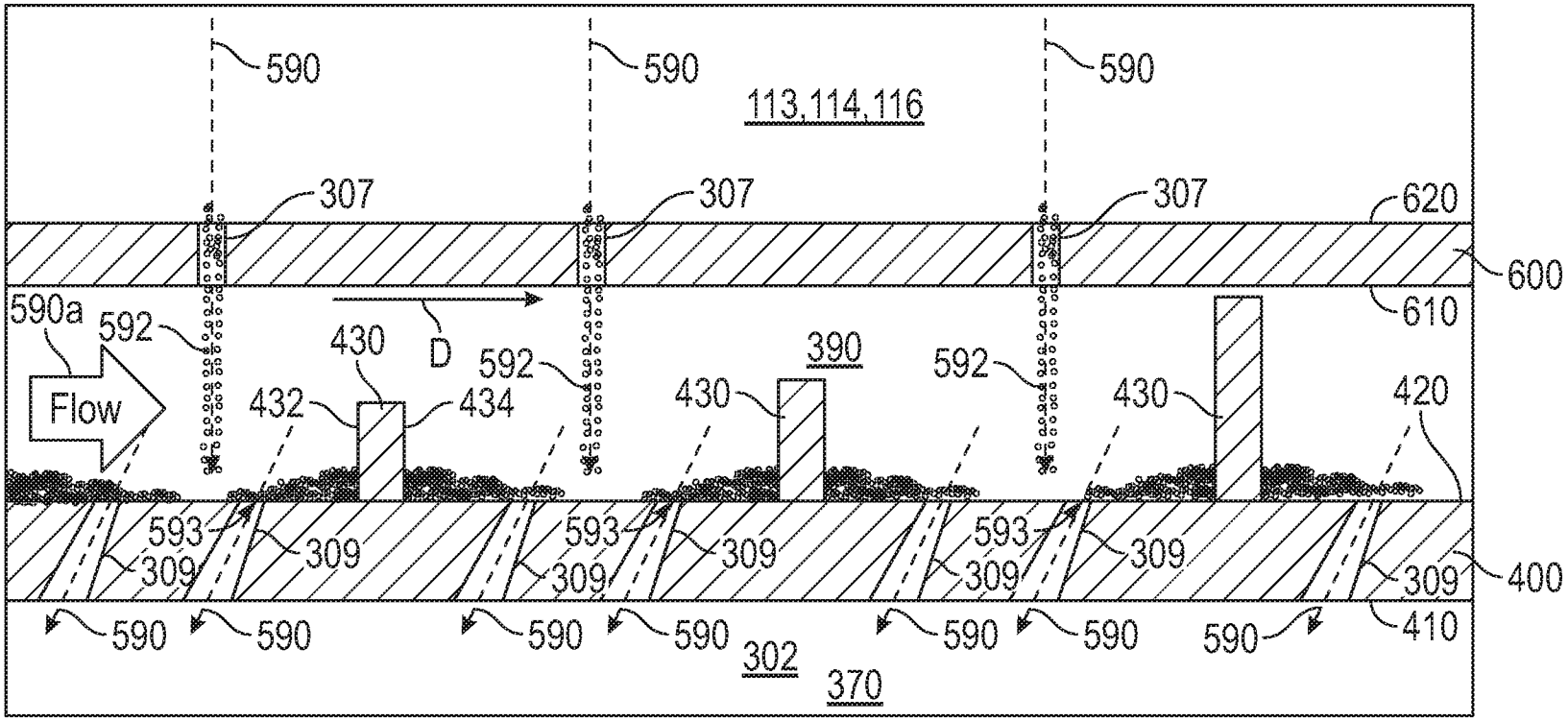
FIG. 3 is an enlarged cross-sectional illustration of a heat shield panel and combustion liner of a combustor, in accordance with an embodiment of the disclosure.

The combustor 300, as shown in FIG. 2, includes multiple heat shield panels 400 that are attached to the combustion liner 600 (See FIG. 3). The heat shield panels 400 may be arranged parallel to the combustion liner 600. The combustion liner 600 can define cylindrical or annular structures with the heat shield panels 400 being mounted on a radially inward liner and a radially outward liner, as will be appreciated by those of skill in the art. The heat shield panels 400 can be removably mounted to the combustion liner 600 by one or more attachment mechanisms 332. In some embodiments, the attachment mechanism 332 may be integrally formed with a respective heat shield panel 400, although other configurations are possible. In some embodiments, the attachment mechanism 332 may be a threaded stud or other structure that may extend from the respective heat shield panel 400 through the interior surface to a receiving portion or aperture of the combustion liner 600 such that the heat shield panel 400 may be attached to the combustion liner 600 and held in place. The heat shield panels 400 partially enclose a combustion area 370 within the combustion chamber 302 of the combustor 300.

Figure 4:
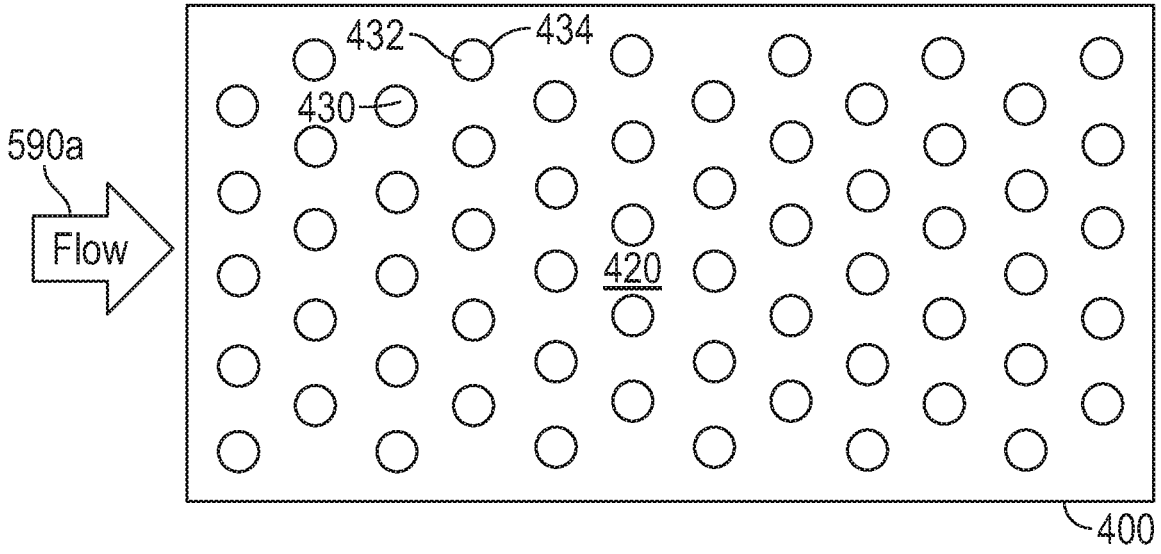
FIG. 4 is a top view of the heat shield panel of FIG. 3, in accordance with an embodiment of the disclosure.

Referring now to FIGS. 3-4 with continued reference to FIGS. 1 and 2. FIG. 3 illustrates a heat shield panel 400 and combustion liner 600 of a combustor 300 (see FIG. 1) of a gas turbine engine 20 (see FIG. 1). FIG. 4 illustrates a top view of the heat shield panel 400 of FIG. 3. The heat shield panel 400 and the combustion liner 600 are in a facing spaced relationship. The heat shield panel 400 includes a first surface 410 oriented towards the combustion area 370 of the combustion chamber 302 and a second surface 420 opposite the first surface 410 oriented towards the combustion liner 600. The combustion liner 600 has an inner surface 610 and an outer surface 620 opposite the inner surface 610. The inner surface 610 is oriented toward the heat shield panel 400. The outer surface 620 is oriented outward from the combustor 300 proximate the inner shroud 114 and the outer shroud 116.

The combustion liner 600 includes a plurality of impingement holes 307 configured to allow airflow 590 from the inner shroud 114 and the outer shroud 116 to enter a cooling channel 390 in between the combustion liner 600 and the heat shield panel 400. Each of the impingement holes 307 extend from the outer surface 620 to the inner surface 610 through the combustion liner 600.

Each of the impingement holes 307 fluidly connects the cooling channel 390 to at least one of the inner shroud 114 and the outer shroud 116. The heat shield panel 400 may include one or more secondary apertures 309 configured to allow airflow 590 from the cooling channel 390 to the combustion area 370 of the combustion chamber 302. The one or more secondary apertures 309 are not shown in FIG. 4 for clarity.

Each of the secondary apertures 309 extend from the second surface 420 to the first surface 410 through the heat shield panel 400. Airflow 590 flowing into the cooling channel 390 impinges on the second surface 420 of the heat shield panel 400 and absorbs heat from the heat shield panel 400 as it impinges on the second surface 420. As seen in FIG. 3, particulate 592 may accompany the airflow 590 flowing into the cooling channel 390. Particulate 592 may include but is not limited to dirt, smoke, soot, volcanic ash, or similar airborne particulates known to one of skill in the art.

As the airflow 590 and particulates 592 impinge upon the second surface 420 of the heat shield panel 400, the particulates 592 may begin to collect on the second surface 420, as seen in FIG. 3. The particulates 592 may tend to collect at various locations on the second surface 420 in such as between locations on the second surface 420 directly opposite the impingement holes 307 and directly at the impact point of the impinging flow. Additional features to enhance surface area and cooling, such as pins, are locations where dirt and particulate build may tend to occur. Pin fins are also used on panels without impinging and effusion holes. The airflow 590 tends to slow down, in locations such as between impingement holes and due to round pin fins 430, and deposits the particulate, and has insufficient velocity to capture and entrain the particulate 592 from the second surface, thus allowing particulate to collect upon the second surface 420. Particulate 592 collecting upon the second surface 420 of the heat shield panel 400 reduces the cooling efficiency of airflow 590 impinging upon the second surface 420 and thus may increase local temperatures of the heat shield panel 400 and the combustion liner 600. Particulate 592 collection upon the second surface 420 of the heat shield panel 400 reduces the heat transfer coefficient of the heat shield panel 400. Particulate 592 collection upon the second surface 420 of the heat shield panel 400 may potentially create a blockage 593 to the secondary apertures 309 in the heat shield panels 400, thus reducing airflow 590 into the combustion area 370 of the combustion chamber 302. The blockage 593 may be a partial blockage or a full blockage.

As shown in FIGS. 3 and 4, the heat shield panel 400 further includes a plurality of round pin fins 430 projecting away from the second surface 420 of the heat shield panel 400 into the cooling channel 390. Each of the plurality of round pin fins 430 may be round in cross section that is cylindrical in shape, as shown in FIGS. 3-4. The round pin fins 430 increase the surface area of the heat shield panel 400 and thus increase the surface area for thermodynamic cooling of the heat shield panel 400. Lateral airflow 590*a* may be directed in the cooling channel 390 in about a lateral direction X1 that is parallel relative to the second surface 420 of the heat shield panel 400. Lateral airflow 590*a* in the cooling channel 390 impinges upon the round pin fins 430 and pulls heat away from the heat shield panel 400, thus cooling the heat shield panel 400. The round shape of the round pin fin 430 may create a flow stagnation point at a front 432 of the round pin fin 430 and a separation point at the back 434 of the round pin fin 430. The lateral airflow 590*a* through the cooling channel 390 slows in speed at the front 432 of the round pin fin 430 due to the shape of the round pin fin 430, thus creating the flow stagnation point at the front 432 of the round pin fin 430. Due to the slowing of the lateral airflow 590*a* at the front 432 of the round pin fin 430, particulate 592 will tend to collect at the flow stagnation point at the front 432 of the round pin fin 430. The lateral airflow 590*a* through the cooling channel 390 slows in speed at the back 434 of the round pin fin 430 due to the shape of the round pin fin 430, thus creating the flow separation point at the back 434 of the round pin fin 430. Due to the slowing of the lateral airflow 590*a* at the back 434 of the round pin fin 430, particulate 592 will tend to collect at the flow separation point at the back 434 of the round pin fin 430.

Figure 5:
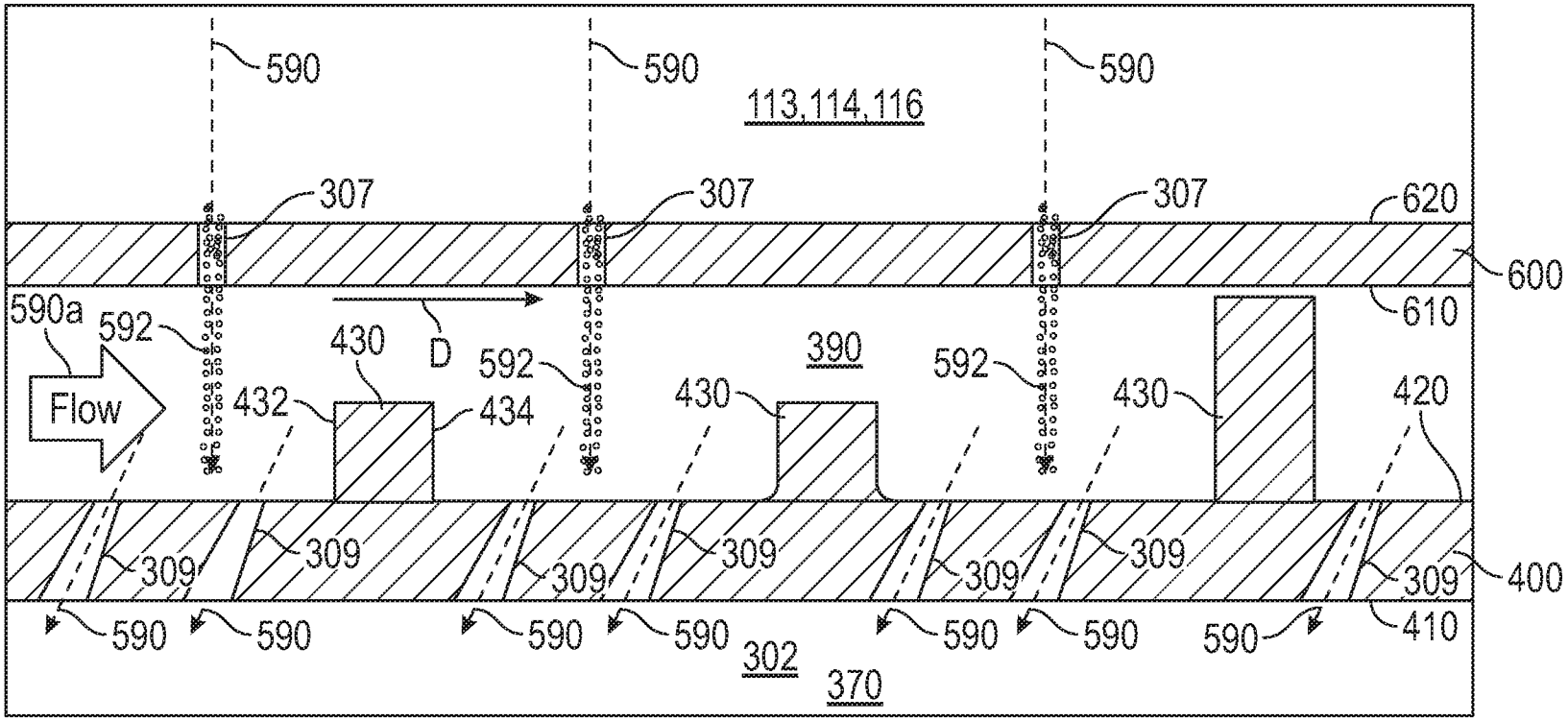
FIG. 5 is an enlarged cross-sectional illustration of a heat shield panel and combustion liner of a combustor, in accordance with an embodiment of the disclosure.
Figure 6:
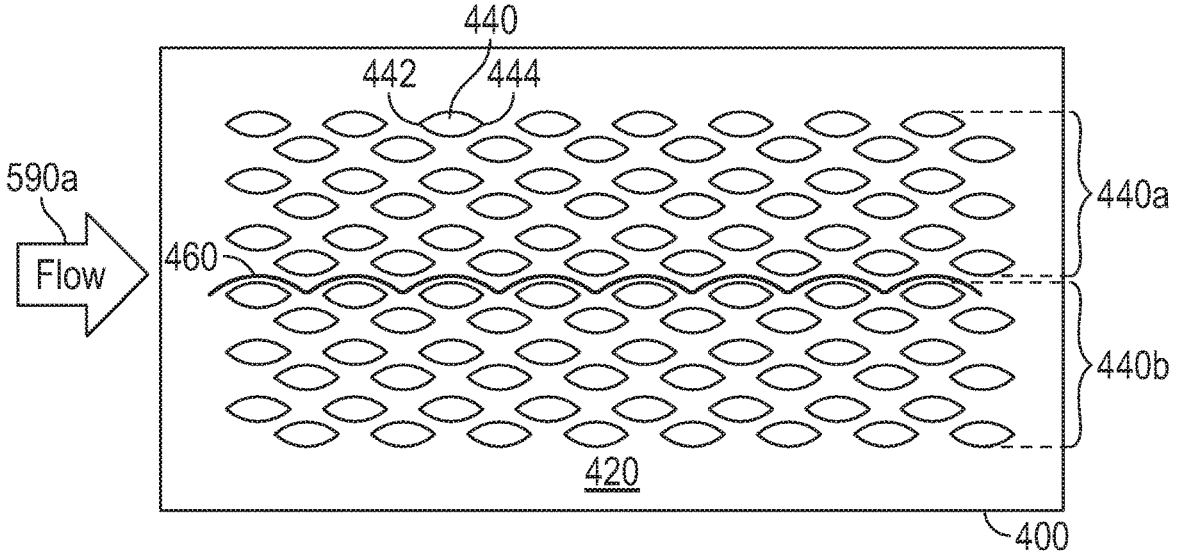
FIG. 6 is a top view of the heat shield panel of FIG. 5, in accordance with an embodiment of the disclosure.

Referring now to FIGS. 5-6 with continued reference to FIGS. 1 and 2. FIG. 5 illustrates a heat shield panel 400 and combustion liner 600 of a combustor 300 (see FIG. 1) of a gas turbine engine 20 (see FIG. 1). FIG. 6 illustrates a top view of the heat shield panel 400 of FIG. 5. The heat shield panel 400 and the combustion liner 600 are in a facing spaced relationship. The heat shield panel 400 includes a first surface 410 oriented towards the combustion area 370 of the combustion chamber 302 and a second surface 420 opposite the first surface 410 oriented towards the combustion liner 600. The combustion liner 600 has an inner surface 610 and an outer surface 620 opposite the inner surface 610. The inner surface 610 is oriented toward the heat shield panel 400. The outer surface 620 is oriented outward from the combustor 300 proximate the inner shroud 114 and the outer shroud branch 116.

The combustion liner 600 includes a plurality of impingement holes 307 configured to allow airflow 590 from the inner shroud 114 and the outer shroud 116 to enter a cooling channel 390 in between the combustion liner 600 and the heat shield panel 400. Each of the impingement holes 307 extend from the outer surface 620 to the inner surface 610 through the combustion liner 600.

Each of the impingement holes 307 fluidly connects the cooling channel 390 to at least one of the inner shroud 114 and the outer shroud 116. The heat shield panel 400 may include one or more secondary apertures 309 configured to allow airflow 590 from the cooling channel 390 to the combustion area 370 of the combustion chamber 302. The one or more secondary apertures 309 are not shown in FIG. 6 for clarity.

Each of the secondary apertures 309 extend from the second surface 420 to the first surface 410 through the heat shield panel 400. Airflow 590 flowing into the cooling channel 390 impinges on the second surface 420 of the heat shield panel 400 and absorbs heat from the heat shield panel 400 as it impinges on the second surface 420.

As shown in FIGS. 5 and 6, the heat shield panel 400 further includes a plurality of pointed ellipse pin fins 440 projecting away from the second surface 420 of the heat shield panel 400 into the cooling channel 390. Each of the plurality of pointed ellipse pin fins 440 have a pointed ellipse shape or marquise diamond shape, as shown in FIGS. 5-6. The pointed end can be somewhat rounded as to permit ease in manufacture. The pointed ellipse pin fins 440 increase the surface area of the heat shield panel 400 and thus increase the surface area for thermodynamic cooling of the heat shield panel 400. Lateral airflow 590*a* in the cooling channel 390 impinges upon the pointed ellipse pin fins 440 and pulls heat away from the heat shield panel 400, thus cooling the heat shield panel 400. The pointed ellipse shape of the pointed ellipse pin fin 440 avoids the creation of a flow stagnation point at a front 442 of the pointed ellipse pin fin 440 and avoids the creation of a separation point at the back 444 of the pointed ellipse pin fin 440. The lateral airflow 590*a* through the cooling channel 390 maintains speed such that the particulates remain entrained in the airflow at the front 442 of the pointed ellipse pin fin 440 due to the shape of the pointed ellipse pin fin 440, thus avoiding the creation of the flow stagnation point at the front 442 of the pointed ellipse pin fin 440. Due to the avoidance of slowing of the lateral airflow 590*a* at the front 442 of the pointed ellipse pin fin 440, particulate 592 will not collect at the front 442 of the pointed ellipse pin fin 440. The lateral airflow 590*a* through the cooling channel 390 maintains the speed necessary to keep the particulates entrained at the back 444 of the pointed ellipse pin fin 440 due to the shape of the pointed ellipse pin fin 440, thus avoiding the creation of a flow separation point at the back 444 of the pointed ellipse pin fin 440. Due to the avoidance of slowing of the lateral airflow 590*a* at the back 444 of the pointed ellipse pin fin 440, particulate 592 will not collect at the flow separation point at the back 444 of the pointed ellipse pin fin 440. Further, fillets can be added at the base of the pins to further reduce the potential and size of stagnation zones.

As also shown in FIG. 6, the pointed ellipse pin fins 440 are arranged in a staggered arrangement. Arranging the pointed ellipse pin fins 440 in a staggered fashion keeps the cross velocity of the lateral airflow 590*a* above a certain critical velocity required to keep the particulates entrained amongst the plurality of pointed ellipse pin fins 440. The fins are staggered such that the lateral airflow 590*a* does not separate or form stagnation regions while traveling through the plurality of pointed ellipse pin fins 440. At lateral airflow speeds 590*a* below a certain value, particulate 592 being carried by the lateral airflow 590*a* will separate from the lateral airflow 590*a*, thus by maintaining the velocity of the lateral airflow 590*a* above that critical velocity through the plurality of pointed ellipse pin fins 440 particulate 592 will be carried through the plurality of pointed ellipse pin fins 440 and out of the cooling channel 390 rather than being deposited on the heat shield panel 400. The staggering arrangement causes the lateral airflow 590*a* to execute a series of turns, which promotes mixing in the lateral flow improving the ability of the flow to pick up heat from the surface. The pointed ellipse pin fins can be arranged in a variety of ways and spacing to match the heat transfer and cooling needs of the panels.

Also further shown in FIG. 6, the combustor 300 may also include a guide rail 460 extending from away from the second surface 420 of the heat shield panel 400 into the cooling channel 390. The guide rail 460 segments the plurality of pointed ellipse pin fins 440 into a first group 440*a* and a second group 440*b*. It is understood that while only one guide rail 460 is shown for illustration any number of guide rails 460 may be utilized to segment the plurality of pointed ellipse pin fins 440 into any number of groups. The guide rail 460 has the intent to direct the airflow to agree with the design intent of the pointed ellipse pins 440, given the possible different shapes and cooling requirements of various different panels. As shown in FIG. 6, the guide rail 460 extends through the plurality of pointed ellipse pin fins 440 in a direction about parallel to a lateral airflow 590 in the cooling channel 390. In an embodiment, the guide rail 460 may be shaped to match the shape of the plurality of pointed ellipse pin fins 440 (e.g., the guide rail 460 is shaped to follow the curvature of the plurality of pointed ellipse pin fins 440).

Figure 7:
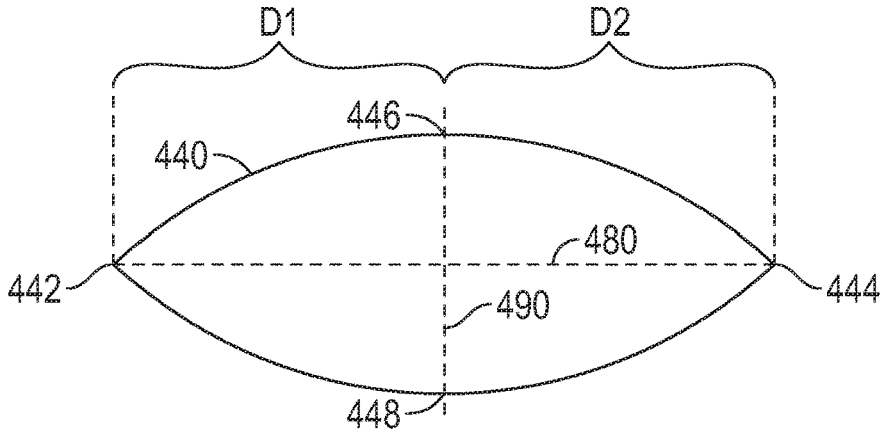
FIG. 7 is a top view of a pointed ellipse pin fin for use in the heat shield of FIGS. 5-6, in accordance with an embodiment of the disclosure.
Figure 8:
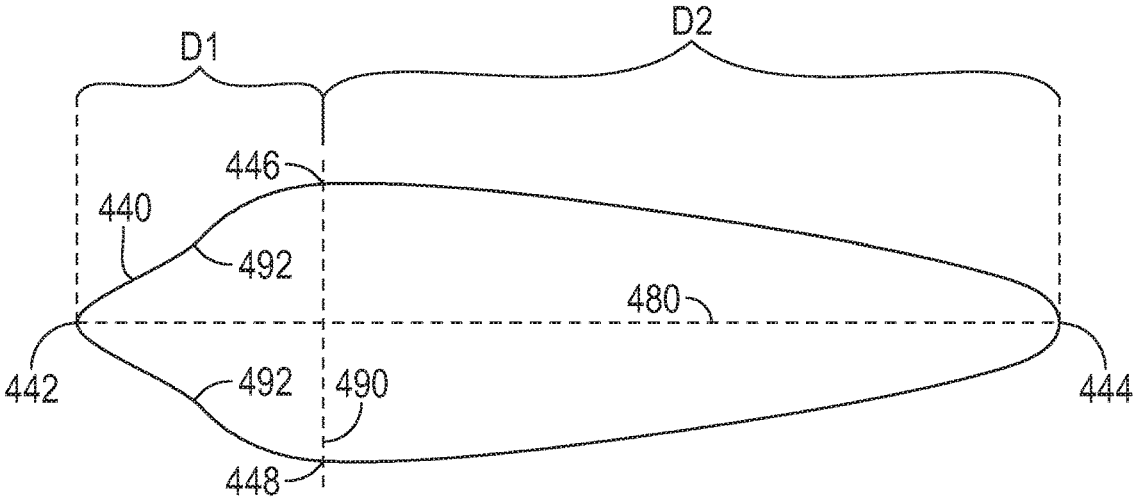
FIG. 8 is a top view of a pointed ellipse pin fin for use in the heat shield of FIGS. 5-6, in accordance with an embodiment of the disclosure.

Referring now to FIGS. 7 and 8, with continued reference to FIGS. 1-6, two different pointed ellipse shapes are illustrated. As shown in FIGS. 7 and 8, the pointed ellipse pin fins 440 includes a major axis 480 and a minor axis 490 perpendicular to the major axis 480. A pointed ellipse shape is defined to cover any ellipse including (i.e., coming to or forming) at least one of a point in a front 442 of the ellipse and a point in a back 444 of the ellipse, as shown in FIGS. 7 and 8. The minor axis 490 may cross the major axis 480 at various location along the major axis 480 in a pointed ellipse shape, as shown by FIGS. 7 and 8. The major axis 480 may be about parallel to the lateral airflow 590*a*. The major axis 480 extends from a front 442 to a back 444 of the pointed ellipse pin fin 440. The minor axis 490 extends from a first co-vertex 446 to a second co-vertex 448. As shown in FIG. 7, in an embodiment, the minor axis 490 bifurcates the major axis 480, such that a first distance D1 between the front 442 and the minor axis 490 is about equal to a second distance D2 between the back 444 and the minor axis 490. As shown in FIG. 8, in another embodiment, the minor axis 490 splits the major axis 480, such that a first distance D1 between the front 442 and the minor axis 490 is less than a second distance D2 between the back 444 and the minor axis 490. The elliptical pin fins 440 may or may not include indents 492 proximate the front 442 of the elliptical pin fins 440 in order to optimize heat transfer and/or particulate 592 tolerance.

It is understood that a combustor of a gas turbine engine is used for illustrative purposes and the embodiments disclosed herein may be applicable to additional components of other than a combustor of a gas turbine engine, such as, for example, a first component and a second component defining a cooling channel therebetween. The second component may have a plurality of pointed ellipse pin fins.

Technical effects of embodiments of the present disclosure include maintaining the velocity of the lateral airflow above that critical velocity through the plurality of pointed ellipse pin fins particulate will be carried through the plurality of pointed ellipse pin fins and out of the cooling channel rather than being deposited on the heat shield panel.

The term "about" is intended to include the degree of error associated with measurement of the particular quantity based upon the equipment available at the time of filing the application. For example, "about" can include a non-limiting range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A gas turbine engine component assembly, comprising:

a first component having a first surface and a second surface opposite the first surface;

a second component having a first surface, a second surface opposite the first surface of the second component, and a plurality of pin fins extending away from the second surface of the second component, the first surface of the first component and the second surface of the second component defining a cooling channel therebetween, wherein the plurality of pin fins extend into the cooling channel, wherein each of the plurality of pin fins have a pointed ellipse shape, wherein each of the plurality of pin fins includes a front, a back opposite the front, a first co-vertex, and a second co-vertex opposite the first co-vertex, wherein each of the plurality of pin fins includes a major axis extending from the front to the back and a minor axis extending from the first co-vertex to the second co-vertex, the minor axis being perpendicular to the major axis, wherein the front and the back are pointed ends of the pointed ellipse shape, wherein an outer surface of each of the plurality of pin fins is convex in shape between the front and the first co-vertex, wherein the outer surface of each of the plurality of pin fins is convex in shape between the front and the second co-vertex, wherein the outer surface of each of the plurality of pin fins is convex in shape between the back and the first co-vertex, and wherein the outer surface of each of the plurality of pin fins is convex in shape between the back and the second co-vertex, and a guide rail extending away from the second surface of the second component into the cooling channel, wherein the guide rail segments the plurality of pin fins into a first group and a second group, wherein the guide rail comprises a plurality of curves joined at pointed ends.

2. The gas turbine engine component assembly of claim 1, wherein the plurality of pin fins are arranged in a staggered arrangement.

3. The gas turbine engine component assembly of claim 1, wherein the guide rail extends through the plurality of pin fins in a direction about parallel to a lateral airflow in the cooling channel.

4. The gas turbine engine component assembly of claim 1, wherein the minor axis bifurcates the major axis, such that a first distance between the front and the minor axis is about equal to a second distance between the back and the minor axis, or wherein a first distance between the front and the minor axis is less than a second distance between the back and the minor axis.

5. The gas turbine engine component assembly of claim 1, wherein each of the plurality of pin fins includes indents proximate the front.

6. A combustor for use in a gas turbine engine, the combustor comprises:

a combustion liner having an inner surface and an outer surface opposite the inner surface;

a heat shield panel having a first surface, a second surface opposite the first surface of the heat shield panel, and a plurality of pin fins extending away from the second surface of the heat shield panel, the inner surface of the combustion liner and the second surface of the heat shield panel defining a cooling channel therebetween, wherein the plurality of pin fins extend into the cooling channel, wherein each of the plurality of pin fins have a pointed ellipse shape, wherein each of the plurality of pin fins includes a front, a back opposite the front, a first co-vertex, and a second co-vertex opposite the first co-vertex, wherein each of the plurality of pin fins includes a major axis extending from the front to the back and a minor axis extending from the first co-vertex to the second co-vertex, the minor axis being perpendicular to the major axis, wherein the front and the back are pointed ends of the pointed ellipse shape, wherein an outer surface of each of the plurality of pin fins is convex in shape between the front and the first co-vertex, wherein the outer surface of each of the plurality of pin fins is convex in shape between the front and the second co-vertex, wherein the outer surface of each of the plurality of pin fins is convex in shape between the back and the first co-vertex, and wherein the outer surface of each of the plurality of pin fins is convex in shape between the back and the second co-vertex, and a guide rail extending away from the second surface of the heat shield panel into the cooling channel, wherein the guide rail segments the plurality of pin fins into a first group and a second group, wherein the guide rail comprises a plurality of curves joined at pointed ends.

7. The combustor of claim 6, wherein the plurality of pin fins are arranged in a staggered arrangement.

8. The combustor of claim 6, wherein the guide rail extends through the plurality of pin fins in a direction about parallel to a lateral airflow in the cooling channel.

9. The combustor of claim 6, wherein the minor axis bifurcates the major axis, such that a first distance between the front and the minor axis is about equal to a second distance between the back and the minor axis, or wherein a first distance between the front and the minor axis is less than a second distance between the back and the minor axis.

10. The combustor of claim 6, wherein each of the plurality of pin fins includes indents proximate the front.

11. A gas turbine engine, comprising:

a combustor enclosing a combustion chamber having a combustion area, wherein the combustor comprises:

a combustion liner having an inner surface and an outer surface opposite the inner surface; and a heat shield panel having a first surface, a second surface opposite the first surface of the heat shield panel, and a plurality of pin fins extending away from the second surface of the heat shield panel, the inner surface of the combustion liner and the second surface of the heat shield panel defining a cooling channel therebetween, wherein the plurality of pin fins extend into the cooling channel, wherein each of the plurality of pointed ellipse pin fins have a pointed ellipse shape, wherein an outer surface of each of the plurality of pin fins is convex in shape between the front and the first co-vertex, wherein the outer surface of each of the plurality of pin fins is convex in shape between the front and the second co-vertex, wherein the outer surface of each of the plurality of pin fins is convex in shape between the back and the first co-vertex, and wherein the outer surface of each of the plurality of pin fins is convex in shape between the back and the second co-vertex, and a guide rail extending away from the second surface of the heat shield panel into the cooling channel, wherein the guide rail segments the plurality of pin fins into a first group and a second group, wherein the guide rail comprises a plurality of curves joined at pointed ends.

12. The gas turbine engine of claim 11, wherein the plurality of pin fins are arranged in a staggered arrangement.

13. The gas turbine engine of claim 11, wherein the guide rail extends through the plurality of pin fins in a direction about parallel to a lateral airflow in the cooling channel.

14. The gas turbine engine of claim 11, wherein the minor axis bifurcates the major axis, such that a first distance between the front and the minor axis is about equal to a second distance between the back and the minor axis, or wherein a first distance between the front and the minor axis is less than a second distance between the back and the minor axis.

* * * * *